United States Patent [19]

Freitas

[11] Patent Number: 4,989,874

[45] Date of Patent: Feb. 5, 1991

[54] LOTTERY SELECTING DICE

[76] Inventor: Harold Freitas, 438 Dutton Ave., San Leandro, Calif. 94577

[21] Appl. No.: 405,867

[22] Filed: Sep. 11, 1989

Related U.S. Application Data

[63] Continuation-in-part of Ser. No. 330,681, Mar. 30, 1989, abandoned.

[51] Int. Cl.[5] ..... A63F 9/04
[52] U.S. Cl. ..... 273/146
[58] Field of Search ..... 273/146

[56] References Cited

U.S. PATENT DOCUMENTS

| | | | |
|---|---|---|---|
| 645,112 | 3/1900 | Mapes | 273/146 |
| 2,077,010 | 4/1937 | Robertson | 273/146 |

FOREIGN PATENT DOCUMENTS

| | | | |
|---|---|---|---|
| 464903 | 5/1950 | Canada | 273/146 |
| 1059816 | 6/1959 | Fed. Rep. of Germany | 273/146 |
| 2432327 | 4/1980 | France | 273/146 |
| 2437853 | 6/1980 | France | 273/146 |

*Primary Examiner*—Edward M. Coven
*Assistant Examiner*—Raleigh W. Chiu
*Attorney, Agent, or Firm*—Linval B. Castle

[57] ABSTRACT

A set of lottery game dice to aid in selecting six numbers between "one" and "forty-nine" to "fifty-three" are regular decahedron shaped. The total of the numbers displayed on the six dice are obtained by using some dice having eight surfaces displaying numbers and some displaying nine numbers. The dice are formed by providing one or two of the ten surfaces with an extending convex numbered surface to prevent the die from settling on that surface, thus eliminating one or two available surfaces for display.

1 Claim, 1 Drawing Sheet

LOTTERY SELECTING DICE

This is a continuation-in-part of my copending patent application, Ser. No. 07/330,681, filed Mar. 30, 1989, now abandoned.

BRIEF SUMMARY OF THE INVENTION

This invention relates to games and particularly to a set of six unusually shaped dice which may be rolled for randomly selecting six numbers from the total ranging between forty-nine and fifty-three available numbers on the set.

Several of our states have legalized state-operated lotteries to satisfy the gaming instincts of their citizenry and to attempt to slow their periodic trips to large legal gambling centers such as Atlantic City and Nevada. Most of these state-operated lotteries sell lottery tickets to patrons who have selected six numbers between the numbers "one" and "forty-nine" with some states increasing the odds by requiring a selection between "one" and "fifty-three". By some selection process, the lottery representatives randomly select six numbers from an available numbers and patrons with tickets having matching numbers are awarded prizes, some of which occasionally reach several millions of dollars.

The selection of the six numbers by the patrons always becomes a problem and often includes some type of superstition, such as numbers selection by a birthdate. Most states provide some sort of "quick pick" method in which the selection may, if desired, be made by a computer so that the patron only need pay for x-number of tickets and the computer deals out the tickets, all with a different six numbers from one to forty-nine or fifty-three as the case may be. This, of course is impersonal gambling and is akin to playing a slot machine. Even though no skill is involved in a lottery, it is much more interesting for one to select his or her own numbers from friend's or family birthdates, telephone numbers, addresses, etc. As an alternate aid in selecting lottery numbers, a set of dice, such as those to be described, may be employed.

In the above discussed lotteries which involve the random selection of six from a total of from forty-nine to fifty-three available numbers, it is necessary that the game include a total of six dice that display on their surfaces the total of the available numbers. These odd requirements are met by providing six dice, some with eight numbered surfaces and some with nine numbered surfaces. Forty-nine available numbers are provided by one die with nine numbered surfaces and five with eight numbered surfaces. Fifty-three numbers are provided by one die with eight numbered surfaces and five dice with nine numbered surfaces. Numbers between forty-nine and fifty-three are provided by varying the number of eight and nine numbered dice. The quantity of eight and nine numbered dice may be determined by the equation, $8n+9m=$the total numbers from which the lottery selects, n is the number of dice displaying eight numbers and m is the number of dice displaying nine numbers. To display this unusual number of numbered surfaces on a decahedron, a die is modified so that certain of the dice cannot stop on certain surfaces to display the opposite surfaces, as will now be illustrated and described in detail.

DESCRIPTION OF THE DRAWINGS

In the drawings which illustrate the preferred embodiments of the invention.

DETAILED DESCRIPTION

Figure 1:
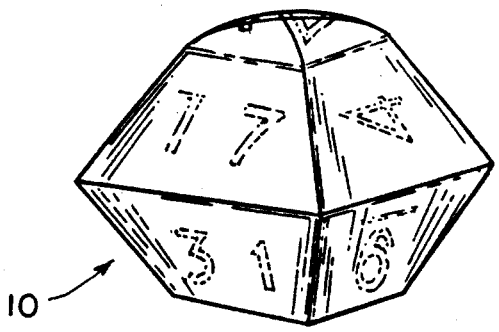
FIG. 1 is a perspective view illustrating a game die displaying nine numbered surfaces.

The lottery selecting game of the invention include six dice having a total of forty-nine to fifty-three surfaces each with a different printed number between the numbers one and forty-nine to fifty-three, depending upon the lottery game adopted. If the game requires a selection of six numbers out of a total of forty-nine, the six dice include five with eight numbered surfaces and one die with nine numbered surfaces. If the game involved a selection from fifty-three numbers, the six dice will include five with nine numbered surfaces and one with eight numbered surfaces. If a game involved a selection from fifty-one numbers, then three dice would have eight numbered surfaces and three would have nine. The rolling of the six dice will therefore display six different numbers which could help in selecting lottery numbers in certain state-operated lotteries. Any game number from forty-nine through fifty-three is available by merely adjusting the ratios of appropriately numbered eight and nine surfaced dice.

FIGS. 1 through 4 illustrate a typical die which displays nine different numbered surfaces. As best shown in the side elevational view and plan view of FIGS. 2 and 3, the die 10 is a solid modified regular decahedron having an equator 12 which may be considered the joined bases of an inverted square pyramidal frustum lower section 14 and a similar but modified upper section 16. The modification of the upper section 16 is the added arcuate sector 18 to the top of the frustum which will prevent the rolled die 10 from coming to rest on that surface, thus leaving only an available four surfaces on section 16 and five surfaces on section 14, or nine surfaces upon which the die 10 can rest.

Figure 3:
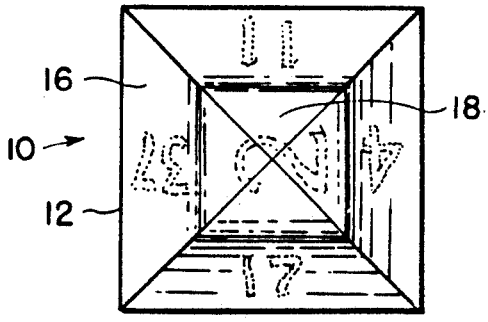
FIG. 3 is a top plan view of the die of FIG. 1.
Figure 2:
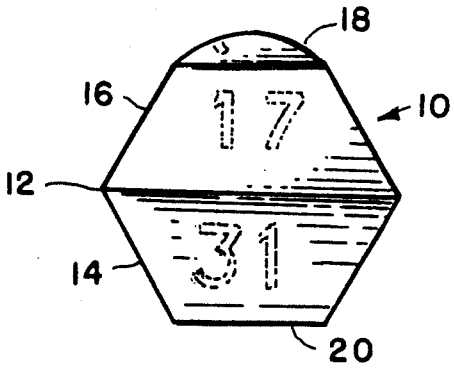
FIG. 2 is an elevational side view of the die of FIG. 1.

FIG. 3 is a top plan view of the die 10 and the upper section 16 with the arcuate top sector 18. Since the surface opposite the sector 18 is a plane, the die can come to rest with the arcuate sector facing upward; therefore, the surface of the arcuate sector 18 contains one of the numbers.

Figure 4:
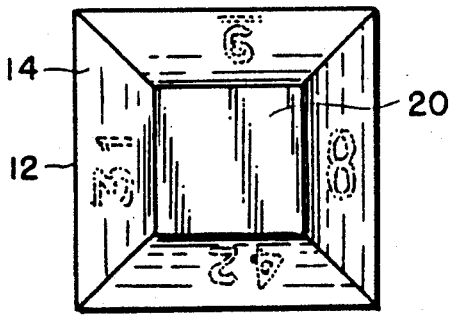
FIG. 4 is a bottom plan view of the die of FIG. 1.

FIG. 4 is a bottom plan view of the die 10 and the lower section 14. The bottom surface 20 of the die is planar and is not numbered since the die cannot rest on the opposite arcuate sector 18 and the plane surface 20 will never be displayed.

Figure 5:
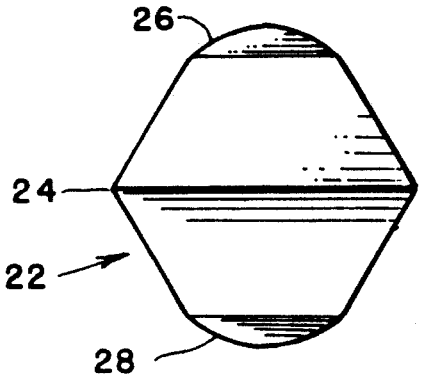
FIG. 5 is a side elevational view illustrating a game die for displaying eight numbered surfaces.

FIG. 5 illustrates one of the five dice that can display numbers on only eight surfaces. The die 22 of FIG. 5 is similar to the die 10 in that it is a modified regular decahedron; both upper and lower sections of the die 22 are identical to the upper section 16 of the die 10 and have been joined at their equator 24. The planar top and bottom surfaces of die 22 have been modified into arcuate sectors 26, 28 so that the die can never come to rest on these ends. The numbering of the die 22 is thus only upon the eight planar sides of the upper and lower sections.

In the preferred embodiment, the regular decahedron shaped dice are formed of conventional plastic material used in dice manufacture. The length of each equator 12, 24 is $\frac{7}{8}$ inches, and the elevational angle between the pyramidal bases and side surfaces of each section is 60°. The length of each planar surface is 7/16 inches and the planar end surface 20 of the die 10 is a 7/16-inch square. The arcuate top and bottom end sectors 18, 26, 28 are formed on an approximate $\frac{3}{8}$-inch radius and are smoothed to be tangent with the edges and smoothed at the corners of the side surfaces. It is to be understood that these dimensions are those of the preferred embodiment and that other sizes may be used as long as each die is equally free to settle onto any planar surface.

I claim:

1. A set of six regular decahedron shaped lottery game dice comprising five dice modified to display nine numbered planar surfaces and one die modified to display eight numbered surfaces, each numbered surface having a different number between the numbers one through fifty-three.

* * * * *